US010039948B2

(12) United States Patent
Chen

(10) Patent No.: US 10,039,948 B2
(45) Date of Patent: Aug. 7, 2018

(54) TRAMPOLINE ANCHOR

(71) Applicant: Samuel Chen, Hong Kong (CN)

(72) Inventor: Samuel Chen, Hong Kong (CN)

( * ) Notice: Subject to any disclaimer, the term of this patent is extended or adjusted under 35 U.S.C. 154(b) by 0 days.

(21) Appl. No.: 15/672,928

(22) Filed: Aug. 9, 2017

(65) Prior Publication Data

US 2017/0333741 A1 Nov. 23, 2017

Related U.S. Application Data

(63) Continuation-in-part of application No. 14/745,832, filed on Jun. 22, 2015, now Pat. No. 9,855,452.

(60) Provisional application No. 62/081,902, filed on Nov. 19, 2014.

(51) Int. Cl.
*A63B 5/11* (2006.01)
*A63B 71/02* (2006.01)

(52) U.S. Cl.
CPC ..... *A63B 5/11* (2013.01); *A63B 71/023* (2013.01); *A63B 2071/026* (2013.01); *A63B 2225/605* (2013.01); *A63B 2225/62* (2013.01)

(58) Field of Classification Search
CPC .... A63B 5/00; A63B 5/08; A63B 5/10; A63B 5/11; A63B 5/12; A63B 5/16; A63B 6/00; A63B 6/02
USPC ..... 482/23, 26–32
See application file for complete search history.

(56) References Cited

U.S. PATENT DOCUMENTS 3,734,496 A * 5/1973 Rubin ..... A63B 5/11 182/139
3,779,201 A * 12/1973 Spahn ..... B63B 1/047 280/206
4,037,834 A * 7/1977 Oaks ..... A63B 69/0035 482/27
4,037,835 A * 7/1977 Forsyth ..... A63B 5/11 248/346.5
4,576,375 A * 3/1986 Roberts ..... A63B 5/11 472/129
5,385,518 A * 1/1995 Turner ..... A63B 5/11 482/23
5,637,057 A * 6/1997 Collura ..... A63B 5/11 482/27
5,810,695 A * 9/1998 Sass ..... A63B 5/11 441/37
6,053,845 A * 4/2000 Publicover ..... A63B 5/11 482/27
6,223,673 B1 * 5/2001 Mears ..... A63B 5/11 114/264
6,447,426 B2 * 9/2002 Peterson ..... A63B 5/11 114/311
6,508,682 B1 * 1/2003 Clark ..... B63B 7/08 441/131
D519,594 S * 4/2006 Brown ..... D21/603
7,789,803 B2 * 9/2010 Plante ..... A63B 5/11 482/27

(Continued)

*Primary Examiner* — Garrett Atkinson
(74) *Attorney, Agent, or Firm* — Clement Cheng

(57) ABSTRACT

A trampoline anchor comprising a trampoline frame, a trampoline bed attached to the trampoline frame, trampoline springs connecting the trampoline frame to the trampoline bed, a fluid chamber formed as a toroidial enclosure, and an outside skirt attached to the fluid chamber, wherein the outside skirt connects between the fluid chamber and the trampoline frame at a fluid chamber skirt connection. The trampoline anchor can also have fluid chamber pods attached to the legs of the trampoline.

8 Claims, 9 Drawing Sheets

(56) References Cited

U.S. PATENT DOCUMENTS

| | | | | |
|---|---|---|---|---|
| 7,833,132 | B2 * | 11/2010 | Hylbert | A63B 5/11 482/27 |
| 8,430,795 | B2 * | 4/2013 | Publicover | A63B 5/11 482/27 |
| 9,283,419 | B2 * | 3/2016 | Chen | A63B 5/11 |
| 9,364,699 | B2 * | 6/2016 | Gordon | A63B 5/11 |
| 2002/0137598 | A1 * | 9/2002 | Publicover | A63B 5/11 482/27 |
| 2003/0064861 | A1 * | 4/2003 | Chen | A63B 5/11 482/27 |
| 2004/0107491 | A1 * | 6/2004 | Publicover | E04H 4/0018 4/498 |
| 2005/0148433 | A1 * | 7/2005 | Wang | A63B 5/11 482/27 |
| 2009/0181827 | A1 * | 7/2009 | Hylbert | A63B 5/11 482/29 |
| 2009/0260148 | A1 * | 10/2009 | Chen | E04H 4/0025 4/506 |
| 2009/0264042 | A1 * | 10/2009 | Chen | A63G 31/12 446/221 |
| 2010/0035730 | A1 * | 2/2010 | Dukart | A63B 5/11 482/27 |
| 2010/0190608 | A1 * | 7/2010 | Publicover | A63B 5/11 482/8 |
| 2010/0229296 | A1 * | 9/2010 | Samuel | E04H 4/0025 4/506 |

* cited by examiner

TRAMPOLINE ANCHOR

The present invention is a continuation in part of U.S. non-provisional application Ser. No. 14/745,832 entitled Trampoline Anchor filed Jun. 27, 2015, by same inventor Samuel Chen, the disclosure of which is incorporated herein by reference, which in turn claims priority from Trampoline Anchor application 62/081,902 filed Nov. 19, 2014, by inventor Samuel Chen, the disclosure of which is incorporated herein by reference.

FIELD OF THE INVENTION

The present invention is in the field of trampoline anchors.

DISCUSSION OF RELATED ART

Trampolines have large surface areas and a light mass compared to the large surface area. A variety of different techniques have been used for holding down outdoor structures in case of sudden winds. Trampolines and other outdoor inflatable devices are often used by children. Therefore, it is important to implement safety measures to keep these children safe using different variations of anchors for outdoor play devices.

U.S. Pat. No. 5,520,364, entitled Detachable Weight Assembly, and Cover for Use in Combination with a Detachable Weight Assembly, issued on May 28, 1996 to Shawn E. Bloxson and Gregory M. Rodriguez, the disclosure of which is incorporated by reference, describes a detachable weight assembly used to immobilize a cover or similar item, such as a beach blanket. U.S. Pat. No. 6,375,145, issued on Apr. 23, 2002 to David M. Payne, entitled Water Filled Ballasts for Swing Set, the disclosure of which is incorporated herein by reference, describes weights attached to the legs of a swingset. The device holds a ballasting medium, water for example, that is used to weigh down the swingset and prevent tipping. Waldemar Dukart's invention entitled Inflatable Jumping Device, presented in United States Patent US2010/0035730, issued on Feb. 11, 2010, the disclosure of which is incorporated herein by reference, is a device that is intended to eliminate the risk of an inflatable trampling shifting or lifting off the ground. The inflatable device has an enclosed tube that is partially filled with liquid to weigh it down.

U.S. Pat. No. 7,682,260, entitled System for Anchoring Inflatable Structures, issued on Mar. 23, 2010 to William N. Whitlock and Charles Brewer, the disclosure of which is incorporated herein by reference, describes a system in which a support structure includes a water receiving anchoring portion that is adjacent to the base of the inflatable structure. Inventor Oliver Auston's international patent publication entitled Safety Anchor Device WO 2010/086648, issued Aug. 5, 2010 describes an inflatable safety anchor device for a person working at a height, that can be filled with liquid and used as a dead-weight anchor device, the disclosure of which is incorporated herein by reference. United States Patent US 2013/0343675, Weight Bag Assembly, issued on Dec. 26, 2013 to Rouben Gourchounian, presents a weight bag that can be filled with sand or water and used as a means of holding down a tent or other inflatable structure, the disclosure of which is incorporated herein by reference.

SUMMARY OF THE INVENTION

A trampoline anchor is connected to a trampoline frame. A trampoline bed is attached to the trampoline frame.

Trampoline springs connect the trampoline frame to the trampoline bed. A fluid chamber is connected to the trampoline frame. A fluid chamber valve allows inflation with a fluid such as water or sand. The fluid chamber valve provides a fluid chamber filling port for receiving a fluid within the fluid chamber.

Optionally, the trampoline anchor may also have an outside skirt attached to the fluid chamber, so that the fluid chamber is configured as a toroid. In a toroidal configuration, the fluid chamber may also be connected to toroidial enclosure skirt, namely an enclosure skirt weighted down by a toroidial fluid chamber that forms a windscreen for blocking air that would otherwise travel under the trampoline to create lift and drag forces. The toroidial enclosure skirt forms an outside skirt that connects between the fluid chamber and the trampoline frame at a fluid chamber skirt connection. The fluid chamber can be formed as both a toroid and as round pods with the round pods supporting the toroid. For example, the fluid chamber toroid could be made of multiple generally elongated pods.

The fluid chamber pods are preferably attached to legs of the trampoline and strapped to the horizontal frame member of the trampoline frame. Additionally, a ground penetrating anchor can have a loop head on a shaft. The loop head can connect to a fluid chamber pod strap. Preferably, the ground penetrating anchor is over 3 feet long in total length.

Figure 1:
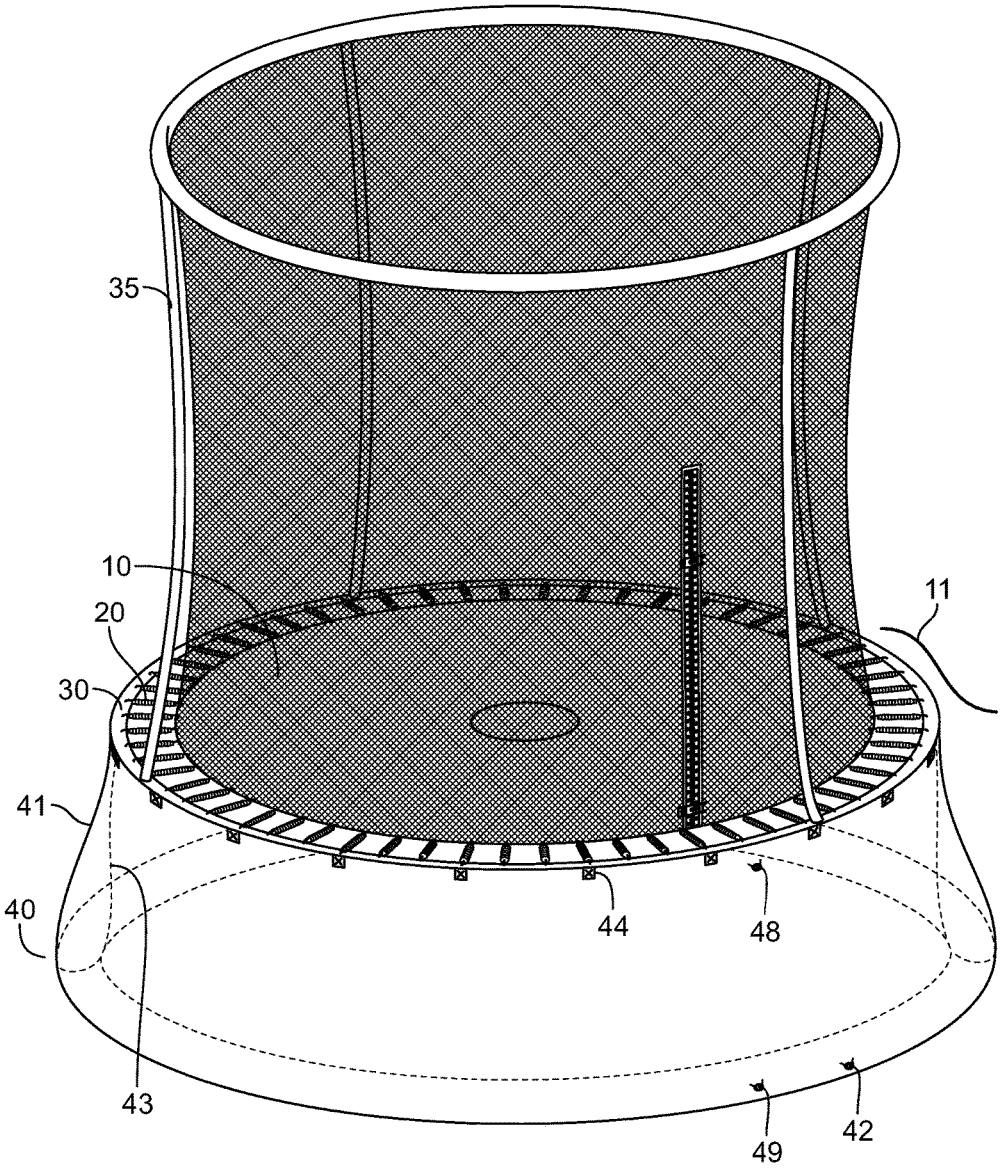
FIG. 1 is a perspective view of the present invention.
Figure 2:
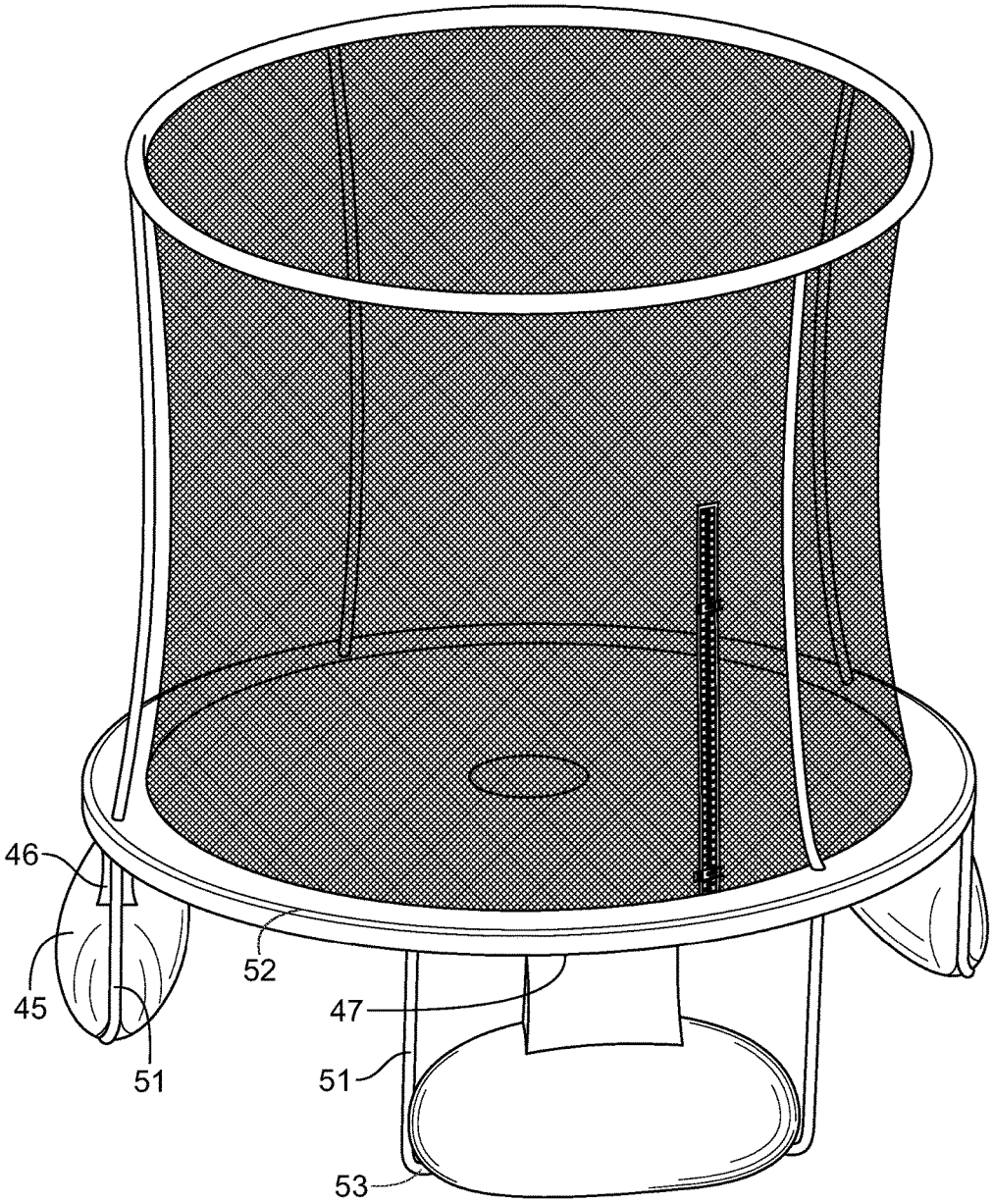
FIG. 2 is a perspective view of the present invention showing the fluid chamber pods.
Figure 3:
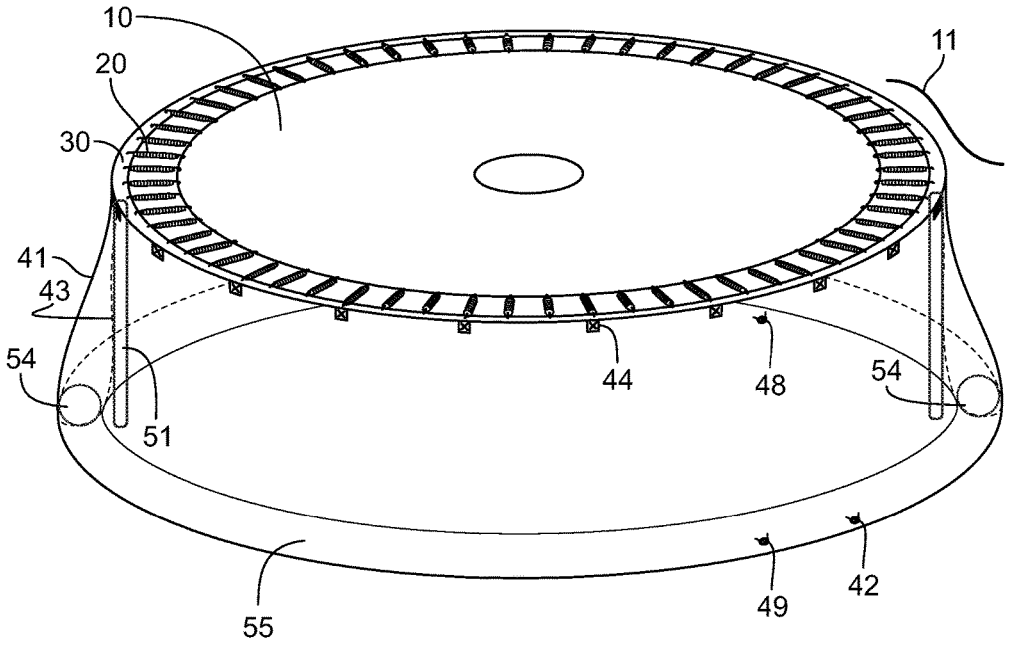
FIG. 3 is a perspective view of the present invention showing a weighted toroid.
Figure 4:
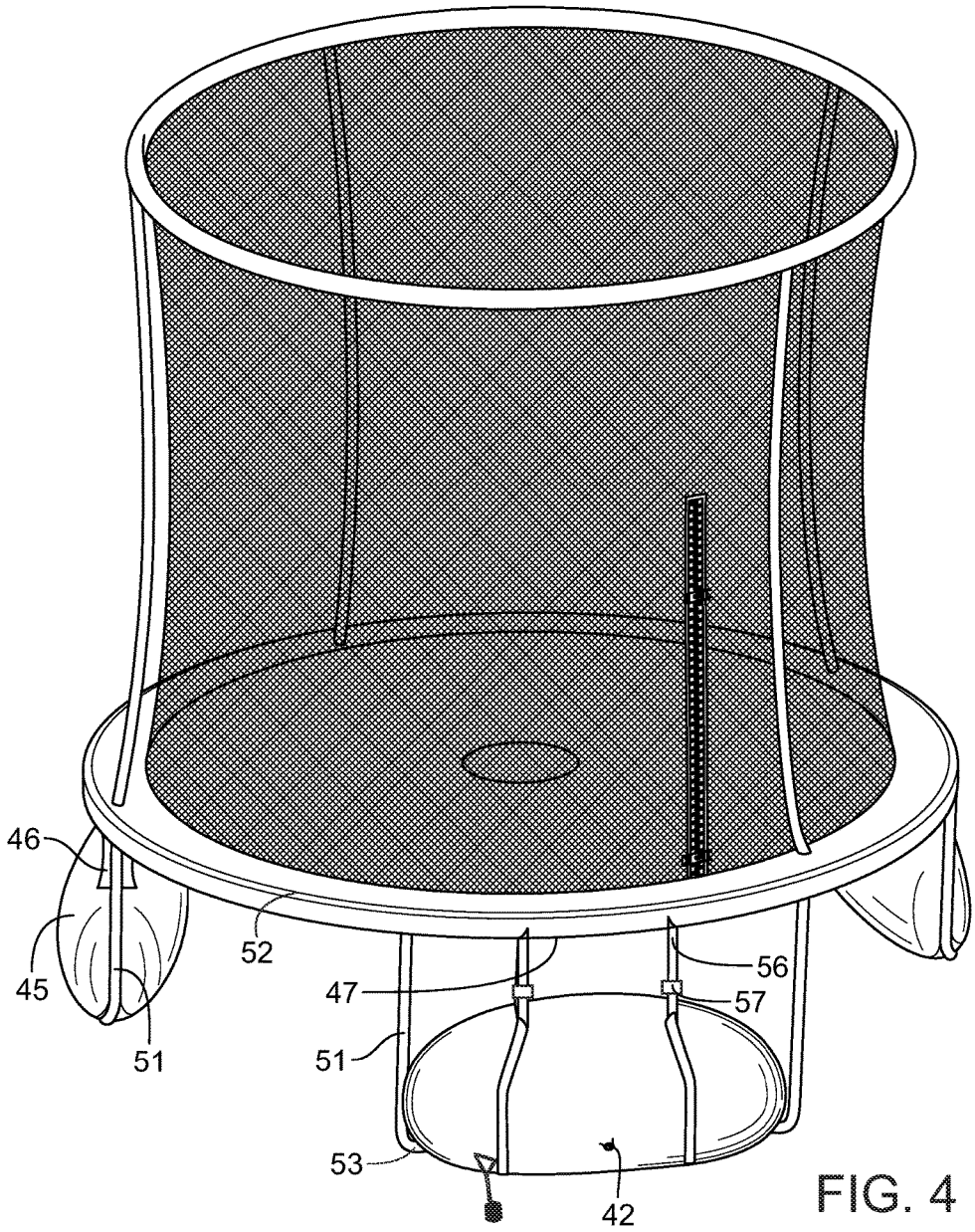
FIG. 4 is a perspective view diagram of the present invention showing the adjustable fluid chamber pod straps.
Figure 5:
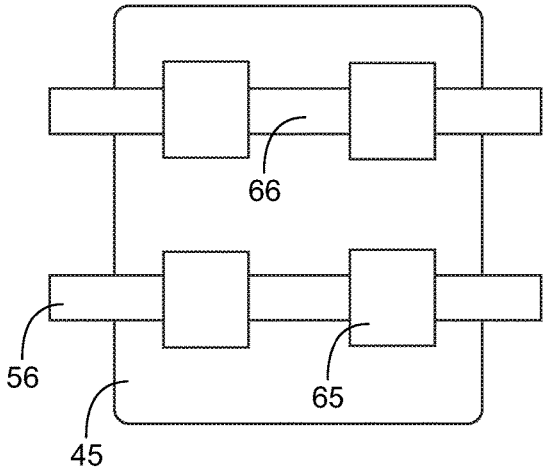
FIG. 5 is a bottom view of the fluid chamber pod.
Figure 6:
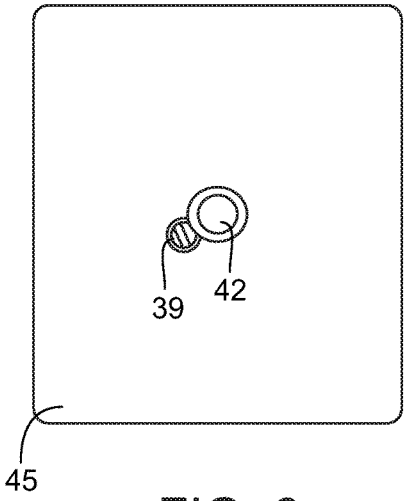
FIG. 6 is a top view of the fluid chamber pod.

The call out list of elements can be a useful guide in referencing the element numbers of the drawings.

10 Trampoline Bed
11 Trampoline Bed Airflow
20 Trampoline Springs
30 Trampoline Frame
35 Trampoline Enclosure
39 Fluid Chamber Valve Handle
40 Fluid Chamber
41 Fluid Chamber Outside Skirt
42 Fluid Chamber Valve
43 Fluid Chamber Inside Skirt
44 Fluid Chamber Skirt Connection
45 Fluid Chamber Pod

46 Fluid Chamber Pod Connector Panel
47 Connector Panel Attachment
48 Inlet Fluid Chamber Valve
49 Outlet Fluid Chamber Valve
51 Vertical Trampoline Leg Member
52 Horizontal Frame Member
53 Horizontal Trampoline Leg Member
54 Toroid Inner Chamber
55 Outward Bulge
56 Fluid Chamber Pod Strap
57 Fluid Chamber Pod Strap Buckle
60 Ground Penetrating Anchor
61 Loop Head
62 Shaft
63 Auger
64 Tip
65 Pod Strap Retainer
66 Loop Head Connection Area
70 Weighted Footing
71 Footing Unit
72 Footing Unit Connection
73 Footing Unit Port
74 Footing Unit Leg Connection
75 Footing Unit Wings
76 Footing Unit Main Portion
77 Water Pool
78 Water Surface Of Water Pool
88 Leg Frame Plane

DETAILED DESCRIPTION OF THE PREFERRED EMBODIMENT

A trampoline generally includes a trampoline bed 10 that can be subject to a trampoline bed airflow 11 when installed outside. Airflow can go over an upper surface of the trampoline bed 10 or under the trampoline bed 10. The trampoline bed 10 is mounted to trampoline springs 20 that connect the trampoline bed 10 to the trampoline frame 30. The trampoline frame 30 generally includes a plurality of legs rigidly connected to and supported by a horizontal frame. The legs include a vertical trampoline leg member 51 that is rigidly connected to a horizontal trampoline leg member 53. The horizontal frame includes a horizontal frame member 52. The trampoline frame 30 preferably is connected to a trampoline enclosure 35.

The preferred embodiment includes an attachment to a trampoline that includes a wind blocking skirt also called the fluid chamber outside skirt 41 as part of a fluid chamber 40. The fluid chamber outside skirt 41 preferably attaches to the horizontal frame members 52 at an upper circumferential periphery of the trampoline frame 30. The fluid chamber outside skirt 41 can be formed as a toroidial enclosure skirt when the fluid chamber outside skirt 41 is formed as a sleeve for receiving a toroidial shaped fluid chamber.

The trampoline frame 30 has a weighted attachment formed as a fluid chamber 40. The weighted attachment has a fluid chamber which can be at least partially filled with a filler such as sand, water, gravel or the like. Sand, water, and gravel can all have fluid like properties to allow partial inflation of the weighted attachment. As the filler is received into the fluid chamber, the fluid chamber expands and forms a seal between the ground and the trampoline frame. The fluid chamber outside skirt 41 can be filled with a hardening material such as concrete for providing a permanent in ground installation. The fluid chamber outside skirt forms a continuous envelope that blocks air from passing underneath the trampoline bed 10 and redirects airflow around the fluid chamber outside skirt 41 such as to the left and right of the fluid chamber outside skirt 41 and also over the trampoline bed.

An inlet fluid chamber valve 48 can be placed at an upper portion of the fluid chamber outside skirt 41, and an outlet fluid chamber valve 49 can be placed at an inlet portion of the fluid chamber outside skirt 41. Fluid that is retained in the fluid chamber 40 can be filled with the inlet fluid chamber valve 48, and then exhausted using the outlet fluid chamber valve 49. The fluid chamber valves are preferably watertight, having a seal such as an O-ring seal.

The first embodiment fluid chamber is continuous around the frame of the trampoline and forms a skirt that is weighted and holds down the periphery of the trampoline frame. The skirt has a toroidial donut shaped fluid chamber that conforms to the ground when the fluid chamber is filled, such as by water or sand. The fluid chamber is connected to a fluid chamber outside skirt and a fluid chamber inside skirt. The inside skirt and the outside skirt can be configured to enclose the fluid chamber. The fluid chamber valve 42 can allow access to the fluid chamber. The fluid chamber valve 42 protrudes through the fluid chamber outside skirt 41 and can be connected to a garden hose with a coupler formed on the fluid chamber valve. The fluid chamber valve 42 can be placed at an upper or lower portion of the fluid chamber outside skirt 41. One or more fluid chamber valves 42 can be implemented on the trampoline anchor on an outside or inside surface of the fluid chamber 41.

The fluid chamber 40 can have a toroid inner chamber 54 fitting inside the fluid chamber 40. The toroid inner chamber 54 can have a generally circular cross-section before filling and can be placed inside the fluid chamber 40. The toroid inner chamber 54 can be made as a long water bladder having a single long rectangular panel sewn together along its length. The toroid inner chamber 54 can be formed as a tube with a sealed first end and a sealed second end. Optionally, the toroid inner chamber 54 can be formed as a continuous loop. Preferably, the toroid inner chamber 54 is formed as a long tube to facilitate placement and replacement. The sealed first end and the sealed second end can be mechanically connected together by hook and loop tape, straps or the like. The toroid inner chamber 54 can be formed as multiple individual fluid chamber pods 45 that are connected together by straps or hook and loop tape.

The fluid chamber skirt connection 44 connects the fluid chamber outside skirt 41, the fluid chamber inside skirt 43 and the frame 30. The fluid chamber skirt connection 44 can be implemented by installing connectors such as a zipper, ties or straps. The fluid chamber pod 45 is preferably watertight, but does not have to be since coarse grain fluids such as gravel and sand can be held within the fluid chamber pod 45.

An embodiment of the present invention may configure the fluid chamber outside skirt 41 as individual and discrete fluid chambers such as fluid chamber pods that are spaced around the trampoline and specifically laying on top of horizontal tubular members of the trampoline footings 49. The trampoline footings are portions of the frame that form legs for holding the frame down. The fluid chamber pod 45 is attached to a trampoline frame by a fluid chamber connector panel 46 which connects to a connector panel attachment 47. The connector panel attachment 47 can be formed as a loop that fits around the circumferential portion of the upper trampoline frame. The fluid chamber pod 45 embodiment can be used in conjunction with the continuous skirt embodiment by installing both to the trampoline frame.

The fluid chamber pod 45 is preferably made of a flexible plastic bag capable of holding a fluid such as water. The fluid chamber pod 45 preferably has a side wall thickness sufficient to retain a fluid such as sand or water. The fluid chamber pod 45 has an outward bulge 55. Also, the fluid chamber inside skirt 43 abuts against the vertical trampoline leg member 51 so that it forms an outward bulge 55. The fluid chamber pod 45 rests upon the horizontal trampoline leg member 53, and the horizontal trampoline leg member 53 rests upon the ground. The fluid chamber pod 45 can conform to the shape of the ground and form a rounded profile. The fluid chamber pod 45 has a lower surface that is flexible and is configured to lay over the horizontal trampoline leg member 53.

Each fluid chamber pod 45 can have a volume of approximately 55 gallons or more and with a six sided trampoline, three of the six sides of the trampoline can have a horizontal trampoline leg member 53 connecting between a pair of vertical trampoline leg members. Each leg can be weighted down by a 450 pound (about 200 kg) fluid chamber pod 45. With three fluid chamber pods, the total weight would be approximately 1370 pounds or 600 kg. The fluid chamber pod can be made of a water bladder fitted inside an external protective fabric cover. The external cover preferably includes one or more openings to allow access to the valves.

The fluid pod connector panel 46 is a fluid chamber pod suspension that can be made as a flap. The fluid chamber pod suspension can also be made as a strap. The strap connects to the bag and provides a lifting connection so that the bag does not completely rest on the ground but rather is suspended from the horizontal frame member 52. Preferably, the lower portion of the strap is configured to pass under the fluid chamber pod and loop under the horizontal trampoline leg member 53. Preferably, the upper portion of the strap connects to or loops around the horizontal frame member 52. The strap preferably biases together and toward each other the inner and outer side walls of the fluid chamber pod so that the fluid chamber pod remains centered between the horizontal frame member 52 and the horizontal trampoline leg member 53.

Figure 8:
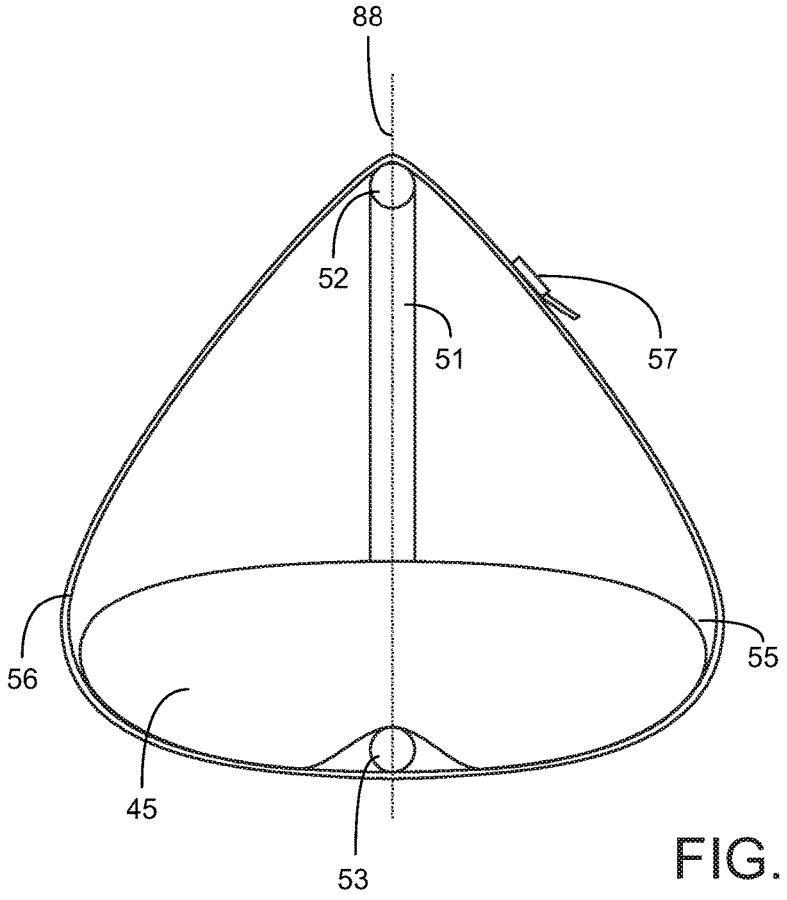
FIG. 8 is a cross-section diagram of the mounting position of the fluid chamber pod taken on a section plane perpendicular to the leg frame plane 88.
Figure 9:
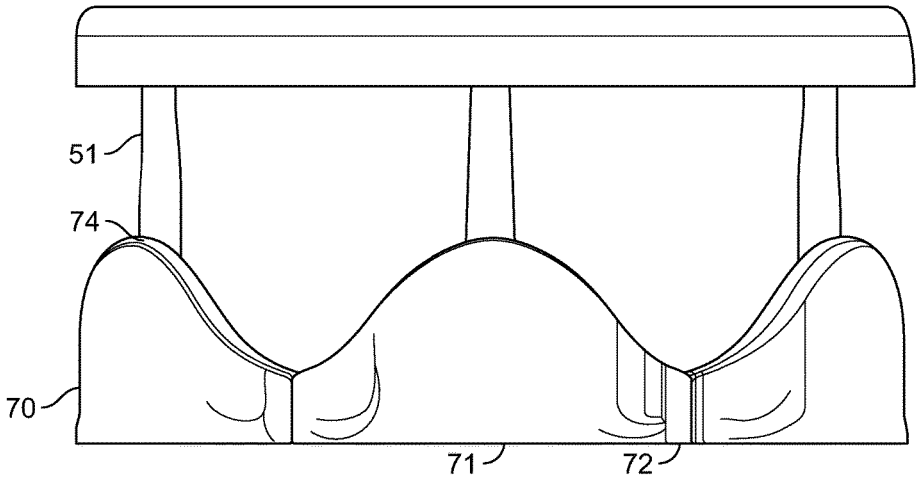
FIG. 9 is a side view of the present invention showing the fluid chamber pods formed as plastic footings.
Figure 10:
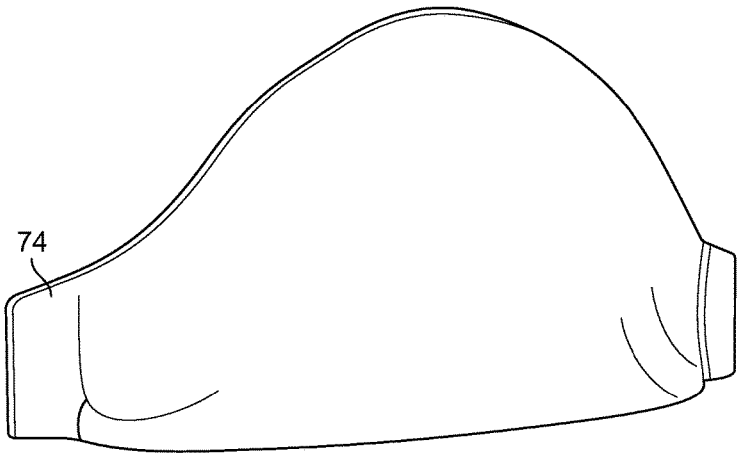
FIG. 10 is a front perspective view of the present invention showing the footing.
Figure 11:
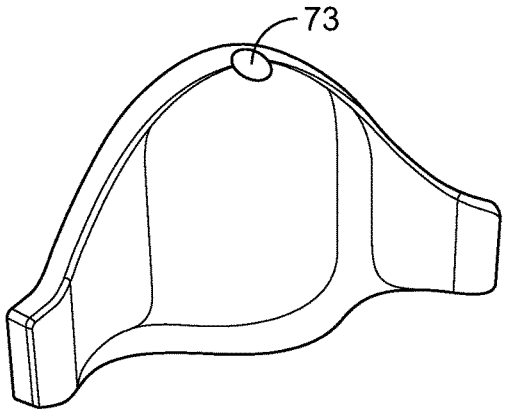
FIG. 11 is a rear perspective view of the footing.
Figure 12:
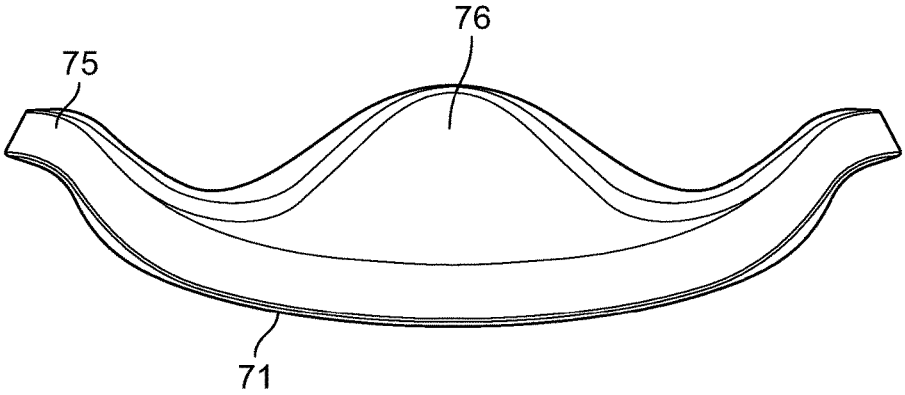
FIG. 12 is a top view of the footing.
Figure 13:
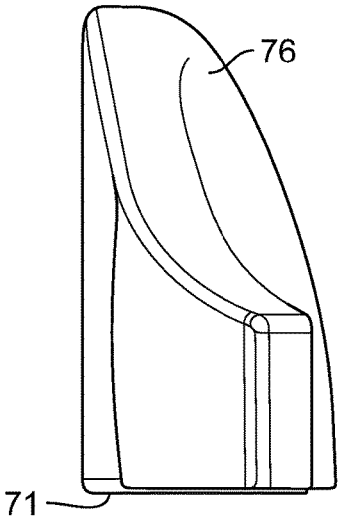
FIG. 13 is a side view of the footing.
Figure 14:
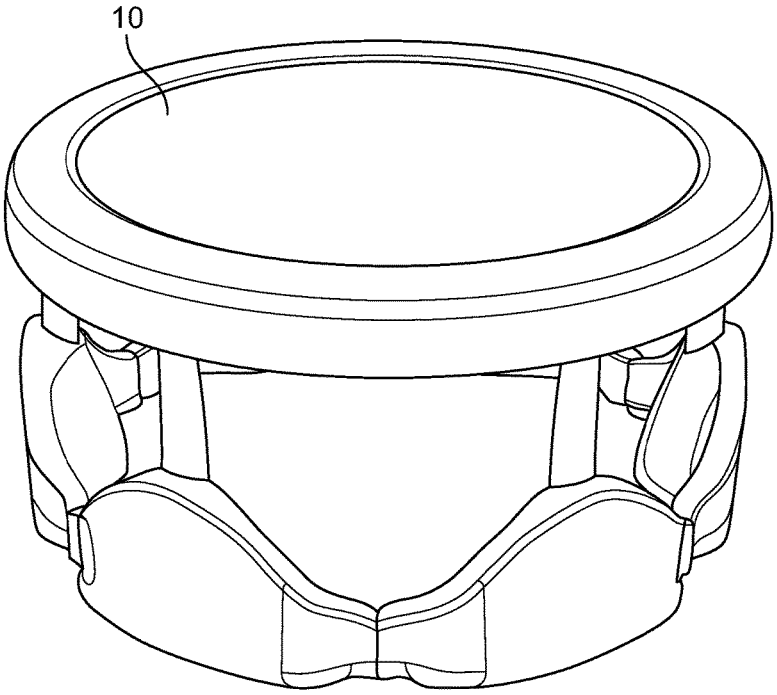
FIG. 14 is an isometric view of the present invention.

The vertical trampoline leg member 51, the horizontal frame member 52 and the horizontal trampoline leg member 53 form a leg frame that is preferably generally rectangular that defines a leg frame plane 88, FIG. 8. The strap aligns the fluid chamber pod to the leg frame plane 88 so that the fluid chamber pod 45 biases the trampoline frame downward with its weight.

Preferably, the strap 56 is adjustable to allow a tightening adjustment after the fluid chamber pod suspension is attached. A user first lays the fluid chamber pod 45 over the horizontal trampoline leg member 53, then the pod strap 56 can be connected to the horizontal frame member 52 and alternatively to the horizontal trampoline leg member 53. The fluid chamber pod 45 can be filled up with a garden hose. After filling, the fluid chamber pod 45 can be drawn upward so that it's weight is not completely sitting on the horizontal trampoline leg member 53. Thus, the fluid chamber pod 45 is at least partially suspended from the horizontal trampoline like member 53 while the portion of the fluid chamber pod 45 rests on the horizontal trampoline leg member 53. The pod strap 56 can have a slip buckle formed as the fluid chamber pod strap buckle 57 that allows a user to pull on a free end of the pod strap that protrudes from the slip buckle to effectuate a tightening of the pod strap 56 to raise it to an at least partially suspended position.

The pod strap 56 can wrap around the fluid chamber pod 45, or can be stitched to an external surface of the fluid chamber pod 45. The pod strap retainer 65 retains the pod strap to the fluid chamber pod 45. A pod strap 56 such as a first pod strap and a second pod strap can provide a secure connection to the fluid chamber pod 45. Since the fluid chamber pod 45 is filled with a fluid such as water or sand, the pod strap 56 can also be supplemented by a ground penetrating anchor 60. The loop head 61 can also be connected to the fluid chamber pod 45 at a variety of different locations. The fluid chamber valve 42 can further include a fluid chamber valve handle 39 that has a recessed semicircular shape to allow a user to grasp the fluid chamber valve handle 39. The fluid valve 42 can be placed on a side or top of the fluid chamber pod 45. The fluid chamber pod can be stacked in multiples such as in 5 gallon increments.

Figure 7:
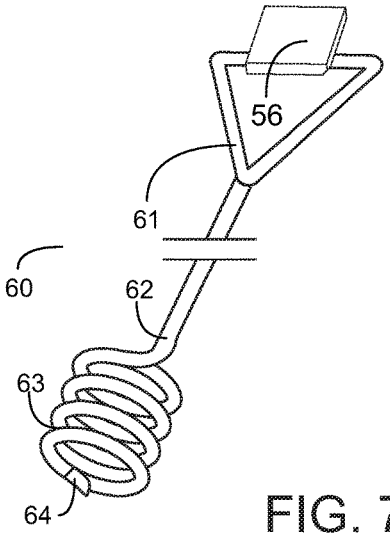
FIG. 7 is a diagram of a ground penetrating anchor that secures to the fluid chamber pod.

The pod strap 56 also optionally connects to a ground penetrating anchor 60 that secures to the ground by a screw type twist motion of a shaft of the ground penetrating anchor 60. The pod strap 56 can be passed through the loop head 61 of the ground penetrating anchor 60 after the ground penetrating anchor 60 is installed into the ground so that the loop head 61 is between the pair of pod strap retainers at a loop head connection area 66 on the bottom surface of the fluid chamber pod 45. The ground penetrating anchor 60 has a loop head 61. The loop head 61 can be circular or triangular as shown in FIG. 7. The loop head 61 can receive a tool such as a long rod like a prybar, not shown, for turning the loop head. Although the shaft 62 is shown as an indeterminate length in FIG. 7, the shaft 62 is preferably over three feet long or at least more than a meter in total length to allow the anchor to penetrate the ground to a deep enough level to resist pulling out during windy conditions. The auger 63 has a screw-type mechanism with preferably a right-handed orientation to allow screwing into the ground from the moment imparted to the loop head 61 by a user. The auger 63 can be formed as a coil or screw or other type of mechanical helical configuration.

The trampoline anchor can also be used when the trampoline anchor is heavier than the weight of water. In this case, the trampoline anchor can allow a trampoline to be installed underwater. The trampoline anchor can be a full chamber pod formed as a plastic footings. The plastic footing can be made heavier than water by adding weights such as sand or metal. For example, the lower portion of a plastic footing can be made of metal. As seen in FIGS. 9-15, the footing unit 71 can be formed as six footing units that are attached to a lower portion of a trampoline frame such as the legs of the trampoline frame. The footing unit connection 72 can connect independent footing units 71 together. The footing unit 71 can be filled with a footing unit port 73. The footing unit port 73 can be an opening with a screw plug or cap to allow user to fill with sand or gravel.

Figure 15:
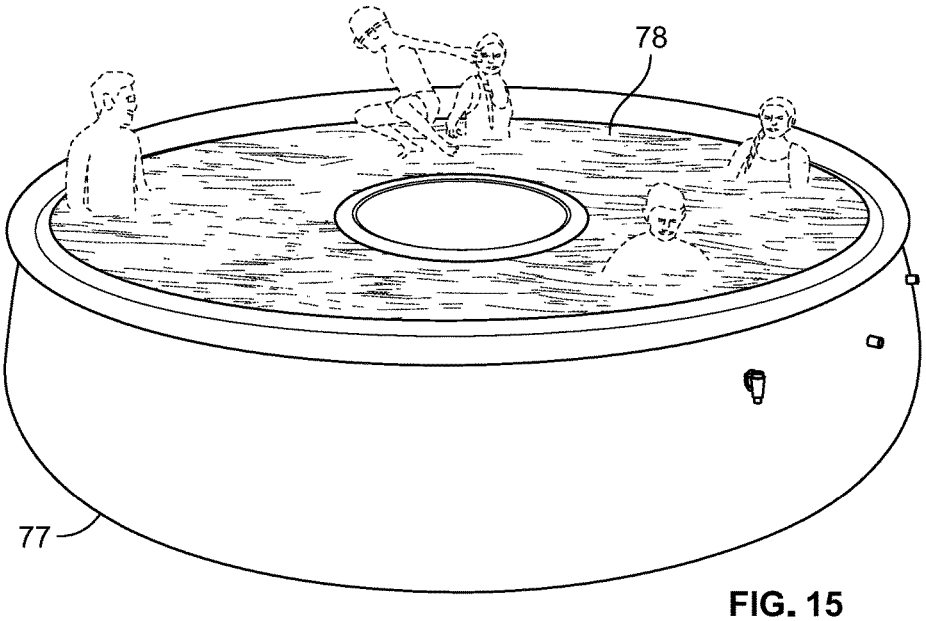
FIG. 15 is a pool installed version of the present invention.

The footing unit 71 is secured to the vertical trampoline leg member 51 at a footing unit leg connection 74. The footing unit 71 has a footing unit main portion 76. A pair of footing unit wings 75 flank the footing unit main portion 76. The pair of footing unit wings 75 extend laterally from the footing unit main portion 76. The footing units 71 can have sockets for receiving vertical trampoline leg members 51. The trampoline anchor allows the trampoline to be placed in a water pool 77 and submerged. The water pool 77 can be an above ground pool as shown in FIG. 15. The water surface 78 of the water pool 77 can be parallel to the trampoline bed just below the trampoline bed.

The footing unit can be formed as a plastic blowmolded member, or can be rotary formed. In either case, it is preferably a plastic housing for retaining a weighted fluid such as sand. The blowmolded member can have a thickness that allows encapsulation of a weight such as sand. Water can be introduced into the blowmolded member also to fill voids. The fluid chamber is configured for retaining a weight that has a density higher than water.

The invention claimed is:

1. A trampoline anchor comprising:

a. a trampoline frame having a horizontal frame member, wherein the trampoline frame includes legs which include a vertical trampoline leg member that is rigidly connected to a horizontal trampoline leg member;

b. a trampoline bed attached to the trampoline frame at the horizontal frame member;

c. trampoline springs connecting the trampoline frame to the trampoline bed;

d. a fluid chamber connected to the trampoline frame at the horizontal frame member, wherein the fluid chamber is configured for retaining a weight that has a density higher than water, wherein the fluid chamber is for weighing down the trampoline frame, wherein the fluid chamber comprises a footing unit, wherein the footing unit secured to the vertical trampoline leg member at a footing unit leg connection, wherein the footing unit has a footing unit main portion; and e. a fluid chamber valve, wherein the fluid chamber valve provides a fluid chamber filling port for receiving a fluid within the fluid chamber so that the fluid chamber is weighted and holds down a periphery of the trampoline frame, wherein the legs and the fluid chamber are both configured to engage the ground, wherein the trampoline anchor is configured with a specific gravity sufficient to submerge the trampoline frame in a water pool, wherein the footing unit has sockets for receiving vertical trampoline leg members, wherein the footing unit is a plastic blowmolded member.

2. The trampoline anchor of claim 1, wherein the footing unit main portion is connected to a pair of footing unit wings that flank the footing unit main portion, wherein the pair of footing unit wings extend laterally from the footing unit main portion.

3. A trampoline anchor comprising:

a. a trampoline frame having a horizontal frame member, wherein the trampoline frame includes legs which include a vertical trampoline leg member that is rigidly connected to a horizontal trampoline leg member;

b. a trampoline bed attached to the trampoline frame at the horizontal frame member;

c. trampoline springs connecting the trampoline frame to the trampoline bed;

d. a fluid chamber connected to the trampoline frame at the horizontal frame member, wherein the fluid chamber is configured for retaining a weight that has a density higher than water, wherein the fluid chamber is for weighing down the trampoline frame, wherein the fluid chamber comprises a footing unit, wherein the footing unit secured to the vertical trampoline leg member at a footing unit leg connection, wherein the footing unit has a footing unit main portion;

e. a fluid chamber valve, wherein the fluid chamber valve provides a fluid chamber filling port for receiving a fluid within the fluid chamber so that the fluid chamber is weighted and holds down a periphery of the trampoline frame, wherein the legs and the fluid chamber are both configured to engage the ground, wherein the trampoline anchor is configured with a specific gravity sufficient to submerge the trampoline frame in a water pool, and further comprising a water pool.

4. The trampoline anchor of claim 3, wherein the water pool is an above ground pool and configured for receiving the trampoline frame.

5. A trampoline anchor comprising:

a. a trampoline frame having a horizontal frame member, wherein the trampoline frame includes legs which include a vertical trampoline leg member that is rigidly connected to a horizontal trampoline leg member, wherein the horizontal frame member and the horizontal trampoline leg member form a leg frame that is generally rectangular;

b. a trampoline bed attached to the trampoline frame at the horizontal frame member;

c. trampoline springs connecting the trampoline frame to the trampoline bed;

d. a fluid chamber connected to the trampoline frame at the horizontal frame member, wherein the fluid chamber is for weighing down the trampoline frame, wherein the fluid chamber is configured for retaining a weight that has a density higher than water, wherein the fluid chamber comprises a footing unit, wherein the footing unit secured to the vertical trampoline leg member at a footing unit leg connection, wherein the footing unit has a footing unit main portion; and e. a fluid chamber valve, wherein the fluid chamber valve provides a fluid chamber filling port for receiving a fluid within the fluid chamber so that the fluid chamber is weighted and holds down a periphery of the trampoline frame, wherein the legs and the fluid chamber are both configured to engage the ground, wherein the footing unit is a plastic blowmolded member.

6. The trampoline anchor of claim 5, wherein the footing unit main portion is connected to a pair of footing unit wings that flank the footing unit main portion, wherein the pair of footing unit wings extend laterally from the footing unit main portion.

7. The trampoline anchor of claim 5, further comprising a water pool.

8. The trampoline anchor of claim 7, wherein the water pool is an above ground pool and configured for receiving the trampoline frame.

* * * * *